US005692765A

United States Patent [19]

Laughlin

[11] Patent Number: 5,692,765

[45] Date of Patent: Dec. 2, 1997

[54] SOFT BOOT STEP-IN SNOWBOARD BINDING

[76] Inventor: James Laughlin, 71 S. Williams #10, Burlington, Vt. 05401

[21] Appl. No.: 473,000

[22] Filed: Jun. 7, 1995

[51] Int. Cl.[6] ..... A63C 9/00; B62B 9/04

[52] U.S. Cl. ..... 280/619; 280/14.2

[58] Field of Search ..... 280/619, 621, 280/620, 14.2, 616, 622, 11.33; 441/70

[56] References Cited

U.S. PATENT DOCUMENTS

| | | | |
|---|---|---|---|
| 3,143,750 | 8/1964 | Kluge | 280/14.2 |
| 4,654,985 | 4/1987 | Chalmers | 36/50 |
| 4,969,278 | 11/1990 | Ottieri | 36/119 |
| 5,556,123 | 9/1996 | Fournier . | |

FOREIGN PATENT DOCUMENTS

| | | | |
|---|---|---|---|
| 0 705 625 A1 | 9/1995 | European Pat. Off. . | |
| 2592807 | 7/1987 | France | 280/14.2 |
| 44 16 023 C1 | 10/1995 | Germany . | |
| WO 90/05466 | 5/1990 | WIPO . | |
| WO 95/33534 | 12/1995 | WIPO . | |

*Primary Examiner*—Brian L. Johnson
*Assistant Examiner*—Jonathan E. Butts
*Attorney, Agent, or Firm*—Wolf, Greenfield & Sacks, P.C.

[57] ABSTRACT

A snowboard binding includes a base plate, a high back member, a toe strap and an in-step strap. The high back member, toe strap and in-step strap are pivotally connected to the base plate so that the high back, toe strap and in-step strap each move between a first open position and a second closed position with respect to the base plate.

27 Claims, 6 Drawing Sheets

SOFT BOOT STEP-IN SNOWBOARD BINDING

BACKGROUND OF THE INVENTION

1. Field of the Invention

The present invention relates to a snowboard binding. More specifically, the present invention relates to a soft boot step-in snowboard binding that includes a base plate, a high back member, and at least one of a toe strap and an instep strap.

2. Discussion of Related Art

Snowboarding has become a very popular sport in recent years. When snowboarding, different style boots are used. For example, snowboard riders use either soft boots (i.e., boots that have a flexible exterior) or hard boots (i.e., boots which have a rigid exterior). Clearly, each of these boots provides separate design considerations for the binding which connects the boot to the snowboard. Hard snowboard boots typically have a hard plastic outer shell that includes structural mechanisms, usually at the toe and the heel of the boot to permit a binding to reliably connect the hard boot to the snowboard. However, soft snowboard boots typically can not be provided with such a structural area of the boot and therefore make the binding of the soft boot to the snowboard more difficult.

U.S. Pat. No. 4,979,760 to Derrah is directed towards a soft boot binding for snowboards. The binding includes a rigid plate 20 which extends to a calf cushion 22. A strap 30 extends from a point just forward of the heal and extends over the instep of the boot to secure the boot in the binding. One end of the strap 30 is physically attached to the heel portion 16 by a screw fastener 34. The other end of the strap 20 extends over the instep portion of the boot and is connected to a conventional serrated strap securing device 36.

U.S. Pat. No. 3,143,750 to Kluge discloses a binding for water skis. The binding includes a vamp 2 which surrounds the instep portion of the foot. A counter 3 is attached to the ski board 1 and engages with the heel portion of the foot. Portion 2*a* of vamp 2 has openings 8 to receive a non-resilient cord 6. The cord 6 is threaded through lateral projections 12 and about one of two bolts 14 to maintain the connection of the foot to the ski.

SUMMARY OF THE INVENTION

Notwithstanding the foregoing binding arrangements, there are still major problems involved with the soft boot snowboard binding that permits the user to simply step into the binding without first having to open up a strap mechanism and thereafter close the strap about the boot. It is therefore an object of the present invention to provide a soft boot step-in snowboard binding that permits the use of conventional soft style boots without requiring any modification to the boot.

It is a further object of the present invention to provide a soft boot binding that permits the user to simply step into the binding without requiring the disconnection and connection of a strap.

It is a further object of the present invention to provide a step-in type soft boot binding that permits the binding to be opened and closed by simply opening and closing a pivoting lever.

It is yet a further object to provide a soft boot snowboard binding that requires less parts and, thus, is smaller and easier to manufacture.

It is still a further object of the present invention that the soft boot step-in snowboard binding be simple and cost effective to manufacture yet reliable and efficient.

In accordance with a preferred embodiment demonstrating further features, objects, and advantageous of the invention, the soft boot step-in binding includes a base plate and a high back member that is pivotally connected to the base plate so that the high back moves between a first open position and a second closed position with respect to the base plate. At least one of a toe strap and an instep strap is connected to the base plate. A first cable has a first end and a second end. The first end of the first cable is connected to the at least one of the toe strap and in-step strap and the second end of the first cable is connected to the high back such that in the first open position, the at least one of the toe strap and instep strap is in an open position with respect to the base plate, and in the high back second closed position, the at least one of the toe strap and inset strap is in a closed position with respect to the base plate.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EXEMPLARY EMBODIMENT

Figure 1:
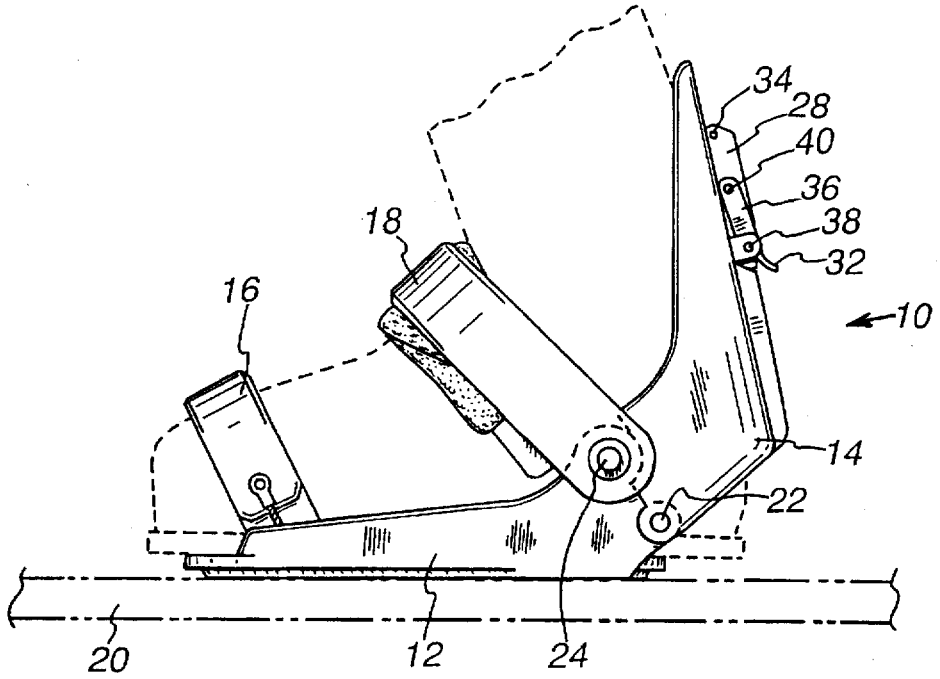
FIG. 1 is a side elevational view of the binding according to the present invention.

Referring now to FIGS. 1–9, a soft boot step-in snowboard binding 10 includes a base plate 12, a high back member 14, a toe strap 16 and an instep strap 18. Base plate 12 is connected to a snowboard 20 by a conventional mechanism and therefore this mechanism has not been illustrated.

Figure 5:
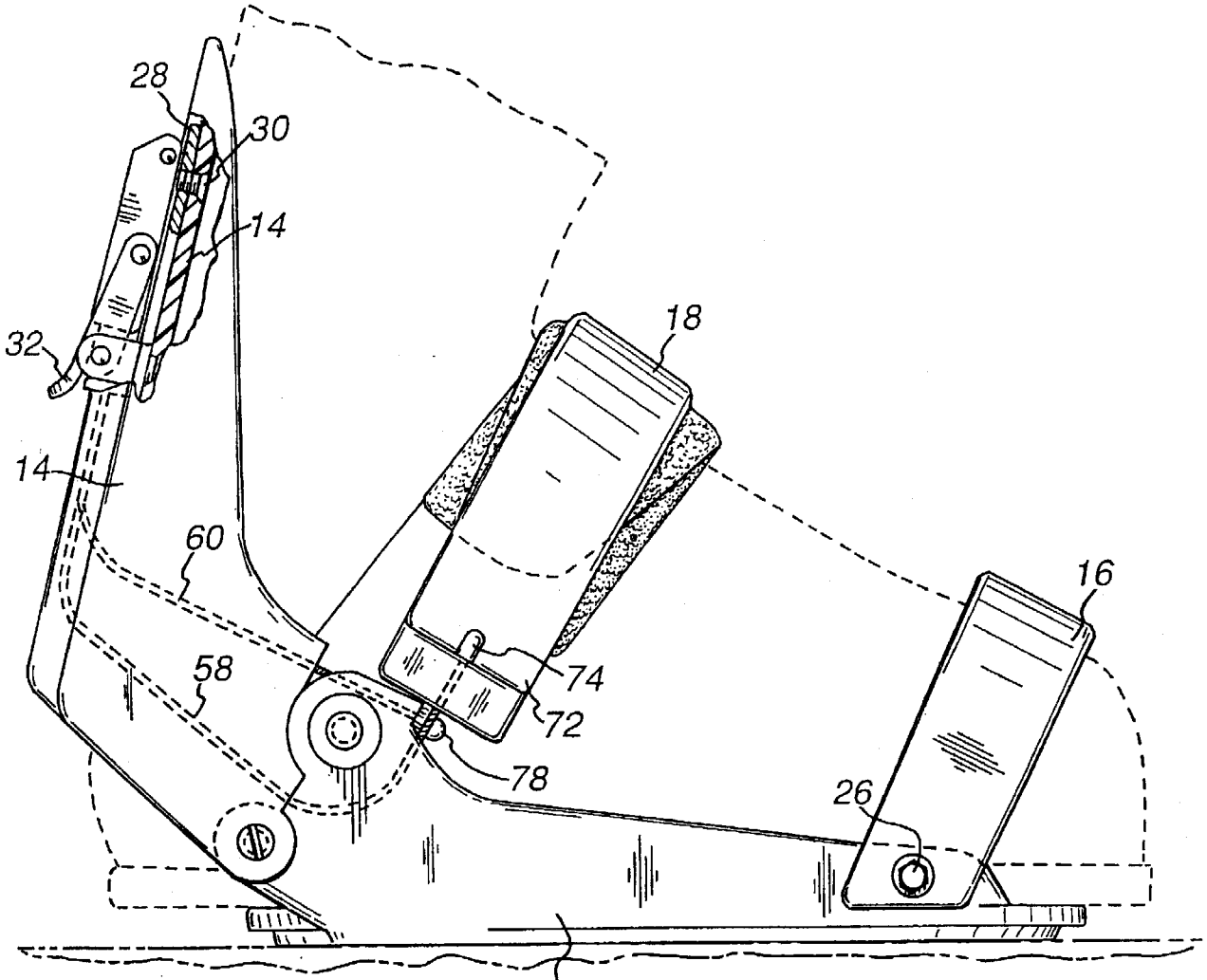
FIG. 5 shows the opposite side elevational view with respect to FIG. 3.
Figure 6:
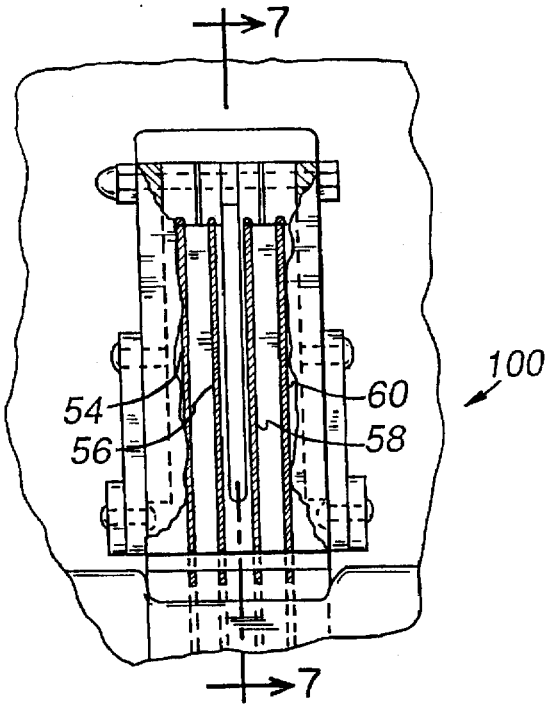
FIG. 6 shows an enlarged view, partially broken away, of the lever operated latch.

High back member 14 is pivotally connected to base plate 12 about pivot axis 22. In-step strap 18 is pivotally connected to base plate 12 about pivot axis 24. In-step strap 16 is pivotally connected to base plate 12 about pivot axis 26 (see FIG. 5). The pivoting connection between the in-step strap 18 and base plate 12 about axis 24 is preferably disposed on the opposite side of base plate 12 with respect to pivoting connection between the toe strap 16 and base plate 12 about axis 26. However, in other embodiments, both of these pivoting connections could be disposed on the same side of the base plate. A lever operated latch 28 is fixedly connected to the high back member 14 by a threaded fastener 30, as illustrated in FIG. 5. Latch 28 includes a pivoting lever arm 32.

Figure 7:
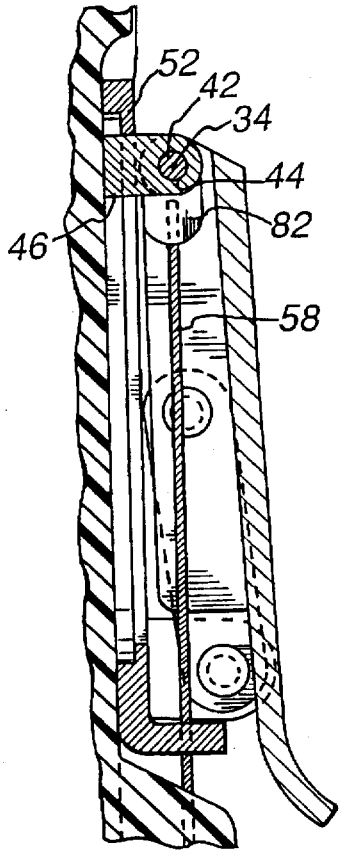
FIG. 7 is a cross-sectional view taken along lines 7—7 of FIG. 6 and looking in the direction of the arrows.
Figure 8:
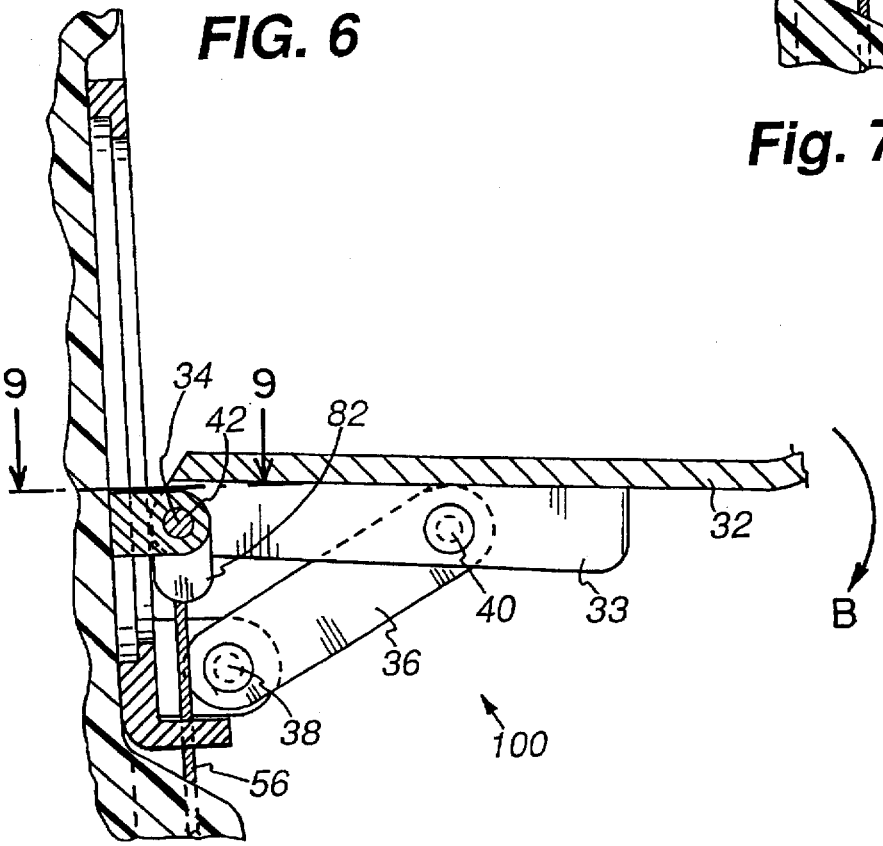
FIG. 8 is a view similar to FIG. 7, but with the lever in the opened position.
Figure 9:
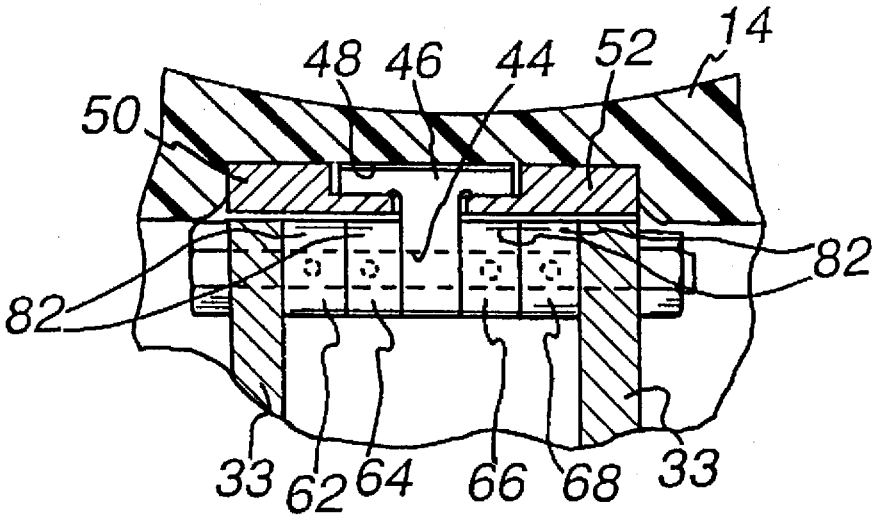
FIG. 9 is a sectional view taken along lines 9—9 of FIG. 8 and looking in the direction of the arrows.

Referring now to FIGS. 6–9, a latch assembly 100 is illustrated, which includes a lever arm 32 pivots about axis 34. A pair of linking arms 36 are pivotally connected to the high back member about fixed pivot axis 38. A second end of each of the links 36 is connected to the lever 32 about pivot axis 40. Lever arm 32 includes a pair of downwardly depending flanges 33 (see FIG. 8). Lever 32 is pivotally connected about moving pivot axis 34 by a pin 42. Likewise, a separate pin member is used to effect all the pivoting connections. Pin 42 passes through a bore in each flange 33 and through a bore 44 disposed in a T-shaped guide member 46. T-shaped member 46 is received within a guide slide 48. Guide slot 48 is disposed on a rear surface of high back member 14. Guide slot 48 is defined by a grooved indentation within the rear surface of high back member 14 and by a reinforcing front member 50, 52. Reinforcing members 50, 52 form a part of the latch assembly 100, and are fixedly connected to high back member 14 after T-shaped member 46 has been disposed within the guide slot 48. Accordingly, T-shaped member 46 is restricted to movement only in the vertical direction as illustrated in FIG. 7. Thus, as the lever 32 is pivoted from the closed position (illustrated in FIGS. 1, 3, 4, 5, 6 and 7) to the opened position (illustrated in FIGS. 2, 8 and 9) the lever arm 32 is lifted in the direction indicated by arrow A in FIG. 2. The lifting of lever arm 32 immediately causes linkage members 36 to pivot about axis 38. The T-shaped member 46 is caused to reciprocate downwardly within guide slot 48 to the lower limit position illustrated in FIGS. 2, 6 and 8. Thus, pin 42 is moved from a first upper limit position illustrated in FIG. 7 to the lower limit position illustrated in FIG. 8. The first ends of each of the four separate cables 54, 56, 58, 60 are connected to pin 42. The first ends of the cables are preferably mounted within an ear 82. Each ear 82 is pivotally mounted about pin 42, as illustrated in FIGS. 7 and 9.

Figure 2:
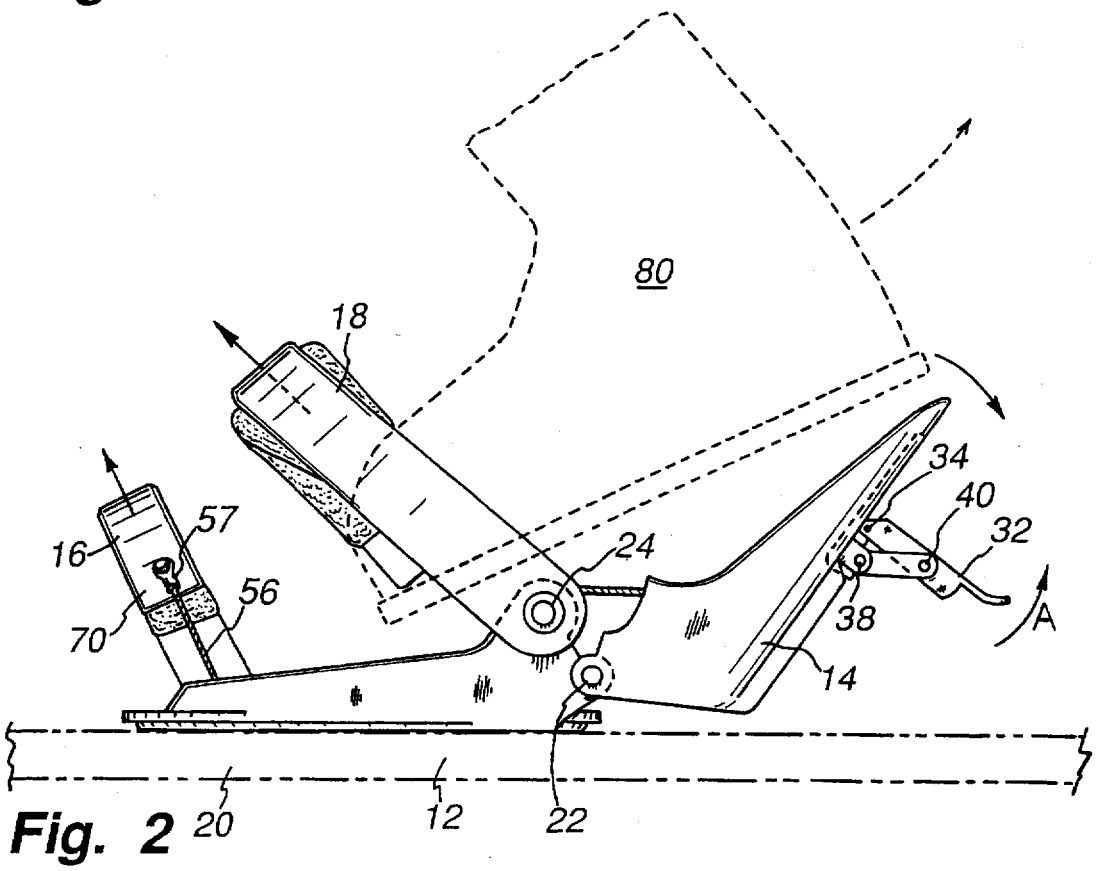
FIG. 2 is a side elevational view of the binding in the open position.
Figure 3:
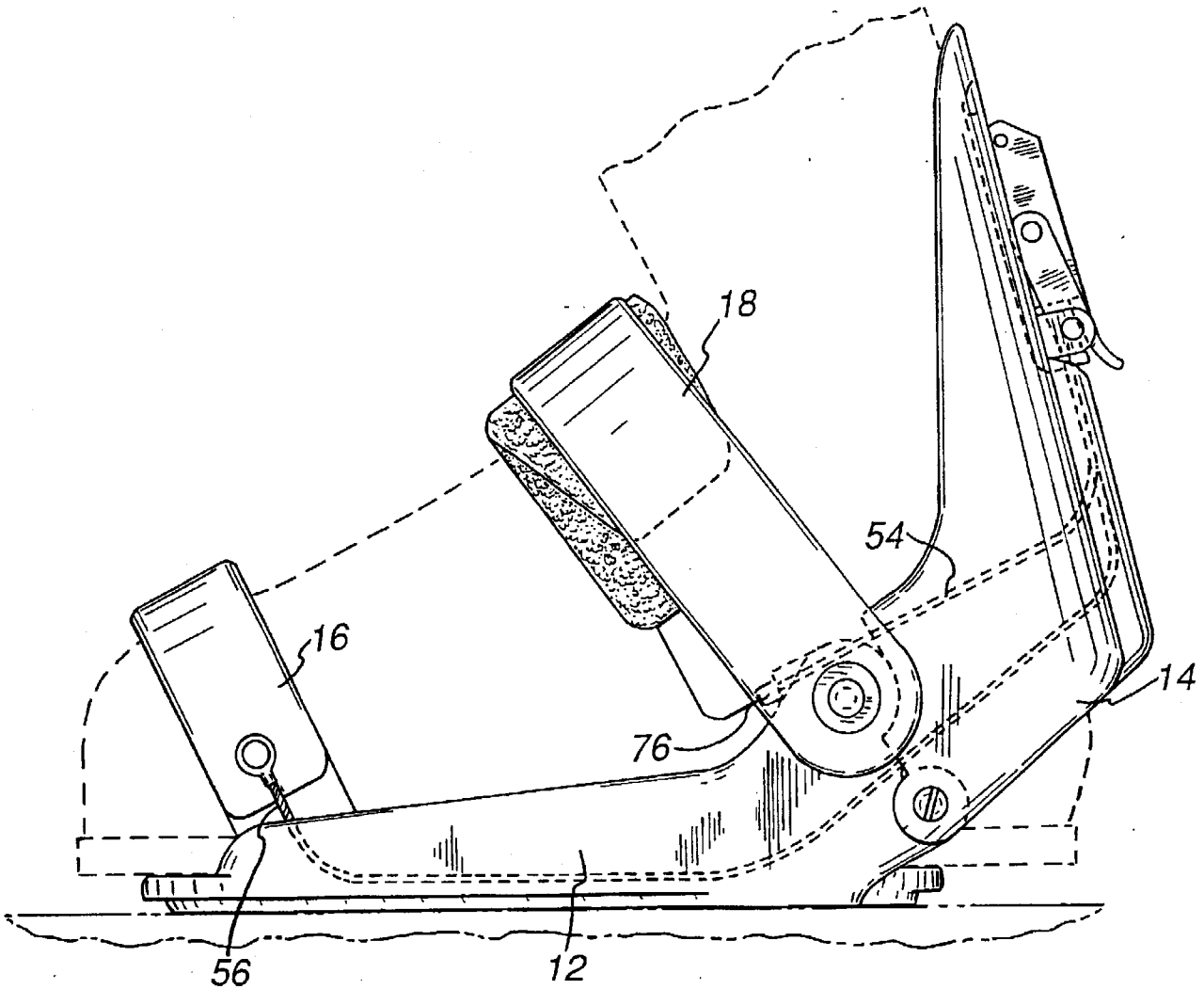
FIG. 3 is a side elevational view of the snowboard boot binding in a closed position showing cable connections between the toe strap, instep strap and the high back.
Figure 4:
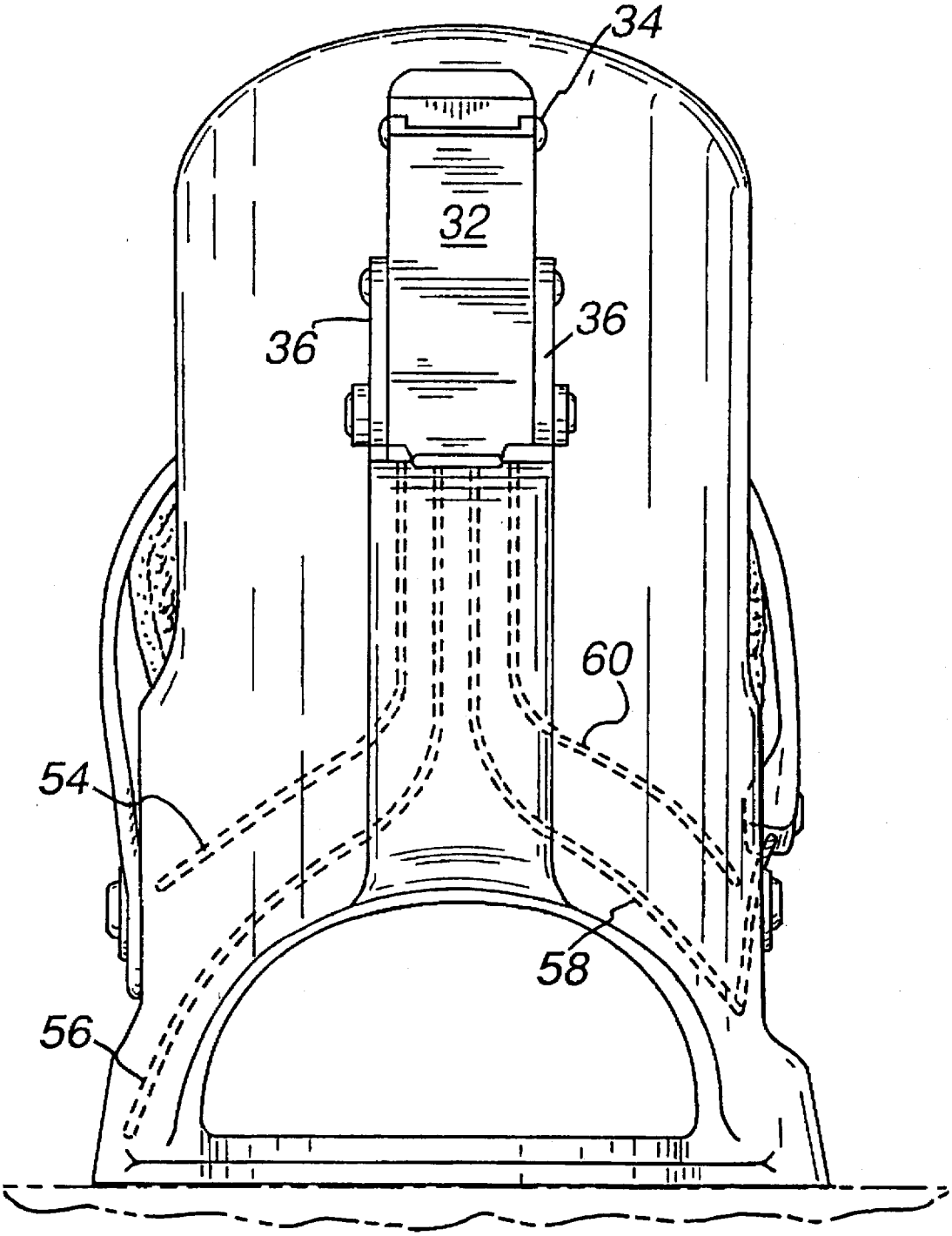
FIG. 4 shows a rear elevational view of the snowboard boot binding.

Cable 56 is guided along the high back member 14 and the base plate 12 and has a second end 57 that is fixedly connected to a second free end of toe strap 16 as illustrated in FIGS. 2 and 3. It should be noted that the free end 70 of toe strap 16 is spaced from the base member 12. Likewise, the free end 72 of in-step strap 18 is spaced from base plate 12 as illustrated in FIG. 5. Strap 58 has a second end 74 that is connected to the free end 72 of the in-step strap 18. Cable 54 has a second end 76 that is connected to base plate 12 as illustrated in phantom in FIG. 3. Likewise, cable 60 has a second end 78 which is connected to the base plate 12, as illustrated in FIG. 5.

During use of the step-in boot binding a user who is wearing a soft boot 80 of conventional shape and design steps into the open binding as illustrated in FIG. 2. In this open position, the toe strap 16 is in an open position with respect to the base plate 12, the in-step strap 18 is in the open position with respect to the base plate 12, and the high back 14 is in an open position with respect to the base plate 12. Once the user's boot 80 is properly positioned with respect to base plate 12, the user can simply close a latch assembly 100 by rotating lever 32 in the direction indicated by arrow B in FIG. 8, which is opposite to the direction indicated by arrow A in FIG. 2. Because of the construction of the latch assembly, rotation of lever 32 in the direction indicated by arrow B, causes pin 42 to move from the lower limit position as illustrated in FIG. 8 to the upper limit position as illustrated in FIG. 7. Thus, the ends of the cables 54, 56, 58, 60 which are attached to pin 42 are each tightened by the distance pin 42 has moved from its lower limit position to the upper limit position. This distance of movement of pin 42 is chosen so that the user can easily and conveniently enter and exit from the soft boot step-in binding when the binding is in the open position as illustrated in FIG. 2 and provides enough tension so that the toe strap 16, in-step 18 and high back member 14 each work in concert with one another to position boot 80 within binding 10 when lever 32 is moved to the closed position. The closing of lever 32 in the direction indicated by arrow B automatically tightens toe strap 16 and in-step strap 18. The motion of lever 32 also tightens straps 54, 60 which causes the high back member 14 to pivot about axis 22, in the counterclockwise direction as illustrated in FIG. 2, to the closed position illustrated in FIG. 1. Thus, toe strap 16, in-step strap 18, and high back member 14 are all simultaneously tightened to ensure a secure and stable binding of a soft snowboard boot. From the preceding description, it will be appreciated that lever 32 has two stable positions by virtue of an over centered spring-type action. In the first stable position, lever 32 is maintained in the opened position, as illustrated in FIG. 8. In the second stable position, the lever 32 is maintained in the closed position, as illustrated in FIG. 7. The basic operation of an over centered spring-type action is well known to those of ordinary skill in the art and needs not be described further.

To release boot 80 from binding 10, the user will simply pivot lever 32 in the direction indicated by arrow A in FIG. 2. The opening of lever 32 will simultaneously release the tension applied on toe strap 16 by cable 56, as well as the tension applied to in-step strap 18 by cable 58 and will release the tension applied between high back member 14 by cables 54, 60 to permit high back member 14 to pivot backwards to the position illustrated in FIG. 2. Thereafter, the user can simply and conveniently remove his or her soft boot from the binding mechanism.

Having described the presently preferred exemplary embodiment of a new and improved soft boot step-in binding, in accordance with the present invention, it is believed that other modifications, variations and changes will be suggested to those skilled in the art in view of the teachings set forth herein. For example, the cables can be formed from wire, rope, chain links, etc. Also, the cables can each be provided with a device to vary the length of each cable so that the proper tension is applied to each cable when the lever is in the closed position. Additionally, further minor adjustment of the toe strap and in-step strap can take place through the use of various independent adjustment devices such as ratcheted straps, air bladders, thumb screws, etc. It is, therefore, to be understood that all such modifications, variations, and changes are believed to fall within the scope of the present invention as defined by the appended claims.

What is claimed is:

1. A rear entry snowboard binding comprising:

a base plate;

a high back pivotally connected to said base plate so that said high back is moveable rearwardly into a first open position that creates an opening which is adapted to allow rear entry of a snowboard boot over and along said rearwardly pivoted high back into said binding, and is retainable forwardly into a second closed position with respect to said base plate that closes off said rear opening;

a toe strap being connected to said base plate; and a first cable having a first end and a second end, said first end of said first cable being connected to said toe strap and said second end of said first cable being connected to said high back such that in said high back first open position, said toe strap is in an open position with respect to said base plate creating an opening adapted to allow rear entry of a snowboard boot along said base plate, and in said high back second closed position, said toe strap is in a closed position with respect to said base plate.

2. The snowboard binding according to claim 1, wherein said toe strap has a first end and a second end, said toe strap first end being pivotally connected to said base plate.

3. The snowboard binding according to claim 2, wherein said toe strap second end is spaced from said base plate.

4. The snowboard binding according to claim 3, wherein said first end of said first cable is connected to said second end of said toe strap.

5. The snowboard binding according to claim 1, further comprising an in-step strap being connected to said base plate.

6. The snowboard binding according to claim 5, wherein said in-step strap has a first end and a second end, said in-step strap first end being pivotally connected to said base plate.

7. The snowboard binding according to claim 3, wherein said in-step strap second end is spaced from said base plate.

8. The snowboard binding according to claim 7, further comprising a second cable having a first end and a second end, said first end of said second cable being connected to said in-step strap and said second end of said second cable being connected to said high back such that in said high back first open position said in-step strap is in an open position with respect to said base plate and in said high back second closed position said in-step strap is in a closed position with respect to said base plate.

9. The snowboard binding according to claim 1, further comprising a third cable having a first end and a second end, said first end of said third cable being connected to said base plate and said second end being connected to said high back.

10. The snowboard binding according to claim 9, further comprising a fourth cable having a first end and a second end, said first end of said fourth cable being connected to said base plate and said second end being connected to said high back.

11. The snowboard binding according to claim 1, wherein said high back includes a lever operated latch.

12. The snowboard binding according to claim 11, wherein said second end of said first cable is connected to said latch.

13. The snowboard binding according to claim 8, wherein said high back includes a lever operated latch, and wherein said second end of said first and second cables are connected to said latch.

14. The snowboard binding according to claim 9, further comprising a second cable having a first end and a second end, said first end of said second cable being connected to said in-step strap and said second end of said second cable being connected to said high back such that in said high back first open position said in-step strap is in an open position with respect to said base plate and in said high back second closed position said in-step strap is in a closed position with respect to said base plate, wherein said high back includes a lever operated latch, wherein said second end of said first, second and third cables are connected to said latch.

15. A rear entry snowboard binding comprising:

a base plate;

a high back pivotally connected to said base plate so that said high back is moveable rearwardly into a first open position that creates an opening which is adapted to allow rear entry of a snowboard boot over and along said rearwardly pivoted high back into said binding, and is returnable forwardly into a second closed position with respect to said base plate that closes off said rear opening;

a toe strap being connected to said base plate;

a first cable having a first end and a second end, said first end of said first cable being connected to said toe strap and said second end of said first cable being connected to said high back such that in said high back first open position said toe strap is in an open position with respect to said base plate creating an opening adapted to allow rear entry of a snowboard boot along said base plate and in said high back second closed position said toe strap is in a closed position with respect to said base plate;

an in-step strap being connected to said base plate; and a second cable having a first end and a second end, said first end of said second cable being connected to said in-step strap and said second end of said second cable being connected to said high back such that in said high back first open position said in-step strap is in an open position with respect to said base plate creating an opening adapted to allow rear entry of a snowboard boot along said base plate and in said high back second closed position said in-step strap is in a closed position with respect to said base plate.

16. The snowboard binding according to claim 15, wherein said toe strap has a first end and a second end, said toe strap first end being pivotally connected to said base plate.

17. The snowboard binding according to claim 16, wherein said toe strap second end is spaced from said base plate.

18. The snowboard binding according to claim 17, wherein said first end of said first cable is connected to said second end of said toe strap.

19. The snowboard binding according to claim 18, wherein said in-step strap has a first end and a second end, said in-step strap first end being pivotally connected to said base plate.

20. The snowboard binding according to claim 19, wherein said in-step strap second end is spaced from said base plate.

21. The snowboard binding according to claim 20, further comprising a third cable having a first end and a second end, said first end of said third cable being connected to said base plate and said second end being connected to said high back.

22. The snowboard binding according to claim 21, further comprising a fourth cable having a first end and a second end, said first end of said fourth cable being connected to said base plate and said second end being connected to said high back.

23. The snowboard binding according to claim 22, further comprising a second cable having a first end and a second end, said first end of said second cable being connected to said in-step strap and said second end of said second cable being connected to said high back such that in said high back first open position said in-step strap is in an open position with a high back pivotally connected to said base plate so that said high back is moveable rearwardly into a first open position that creates an opening which is adapted to allow rear entry of a snowboard boot over and along said rearwardly pivoted high back into said binding, and is retainable forwardly into a second closed position with respect to said base plate that closes off said rear opening; respect to said base plate and in said high back second closed position said in-step strap is in a closed position with respect to said base plate, wherein said high back includes a lever operated latch, wherein said second end of said first, second and third cables are connected to said latch.

24. A rear entry snowboard binding comprising:

a base plate;

a high back pivotally connected to said base plate so that said high back is moveable rearwardly into a first open position that creates an opening which is adapted to allow rear entry of a snowboard boot over and along said rearwardly pivoted high back into said binding, and is returnable forwardly into a second closed position with respect to said base plate that closes off said rear opening;

an in-step strap being connected to said base plate; and a first cable having a first end and a second end, said first end of said first cable being connected to said in-step strap and said second end of said first cable being connected to said high back such that in said high back first open position said in-step strap is in an open position with respect to said base plate creating an opening adapted to allow rear entry of a snowboard boot along said base plate and in said high back second closed position said in-step strap is in a closed position with respect to said base plate.

25. The snowboard binding according to claim 24, wherein said toe strap has a first end and a second end, said toe strap first end being pivotally connected to said base plate.

26. The snowboard binding according to claim 25, wherein said toe strap second end is spaced from said base plate.

27. The snowboard binding according to claim 26, wherein said first end of said first cable is connected to said second end of said toe strap.

* * * * *